US009155183B2

(12) United States Patent
Voronin et al.

(10) Patent No.: US 9,155,183 B2
(45) Date of Patent: Oct. 6, 2015

(54) ADJUSTABLE SLOT ANTENNA FOR CONTROL OF UNIFORMITY IN A SURFACE WAVE PLASMA SOURCE

(71) Applicant: Tokyo Electron Limited, Tokyo (JP)

(72) Inventors: Sergey A. Voronin, Rensselaer, NY (US); Alok Ranjan, Slingerlands, NY (US)

(73) Assignee: Tokyo Electron Limited, Tokyo (JP)

( * ) Notice: Subject to any disclaimer, the term of this patent is extended or adjusted under 35 U.S.C. 154(b) by 521 days.

(21) Appl. No.: 13/750,392

(22) Filed: Jan. 25, 2013

(65) Prior Publication Data

US 2014/0028190 A1 Jan. 30, 2014

Related U.S. Application Data

(60) Provisional application No. 61/674,947, filed on Jul. 24, 2012.

(51) Int. Cl.
*H01Q 1/26* (2006.01)
*H05H 1/46* (2006.01)

(52) U.S. Cl.
CPC ..... *H05H 1/46* (2013.01); *H05H 2001/463* (2013.01); *H05H 2001/4615* (2013.01)

(58) Field of Classification Search
CPC ..... H01J 37/32192; H01J 37/3222; H01J 37/32229; H01J 37/3221; H01J 37/32623; H01J 37/32266; H01J 37/321; H05H 1/46; H05H 1/24; H05H 1/0062; H05H 2001/463; H05H 2001/4615; H05H 2001/4622
See application file for complete search history.

(56) References Cited

U.S. PATENT DOCUMENTS

| | | | | |
|---|---|---|---|---|
| 2004/0095074 | A1* | 5/2004 | Ishii et al. | 315/111.21 |
| 2005/0005854 | A1* | 1/2005 | Suzuki | 118/723 MW |
| 2005/0257891 | A1* | 11/2005 | Goto et al. | 156/345.41 |
| 2006/0071607 | A1* | 4/2006 | Chen et al. | 315/111.01 |
| 2011/0057562 | A1* | 3/2011 | Chen et al. | 315/39 |

* cited by examiner

*Primary Examiner* — Douglas W Owens
*Assistant Examiner* — Raymond R Chai
(74) *Attorney, Agent, or Firm* — Wood, Herron & Evans, LLP

(57) ABSTRACT

The present invention provides a surface wave plasma source including an electromagnetic (EM) wave launcher comprising a slot antenna having a plurality of antenna slots configured to couple the EM energy from a first region above the slot antenna to a second region below the slot antenna, and a power coupling system is coupled to the EM wave launcher. A dielectric window is positioned in the second region and has a lower surface including the plasma surface. A slotted gate plate is arranged parallel with the slot antenna and is configured to be movable relative to the slot antenna between variable opacity positions including a first opaque position to prevent the EM energy from passing through the first arrangements of antenna slots, and a first transparent position to allow a full intensity of the EM energy to pass through the first arrangement of antenna slots.

20 Claims, 3 Drawing Sheets

ADJUSTABLE SLOT ANTENNA FOR CONTROL OF UNIFORMITY IN A SURFACE WAVE PLASMA SOURCE

CROSS REFERENCE TO RELATED APPLICATION

Pursuant to 37 C.F.R. § 1.78(a)(4), this application claims the benefit of and priority to prior filed co-pending Provisional Application Ser. No. 61/674,947, filed Jul. 24, 2012, which is expressly incorporated herein by reference.

FIELD OF THE INVENTION

This invention relates to semiconductor processing technology. Specifically, the invention relates to apparatus and methods for controlling properties of a surface wave plasma source.

BACKGROUND OF THE INVENTION

Typically, during semiconductor processing, a (dry) plasma etch process is used to remove or etch material along fine lines or within vias or contacts patterned on a semiconductor substrate. The plasma etch process generally involves positioning a semiconductor substrate with an overlying patterned, protective layer, for example a photoresist layer, into a processing chamber.

Once the substrate is positioned within the chamber, it is etched by introducing an ionizable, dissociative gas mixture into the chamber at a pre-specified flow rate, while adjusting a vacuum pump to achieve a processing pressure. Then, plasma is formed when a portion of the gas species is ionized by collisions with energetic electrons. The heated electrons dissociate some of the gas species in the gas mixture to create reactant species suitable for the exposed surface-etch chemistry. Once the plasma is formed, any exposed surfaces of the substrate are etched by the plasma at a rate that varies as a function of plasma density, average electron energy, and other factors.

Conventionally, various techniques have been implemented for exciting a gas into plasma for the treatment of a substrate during semiconductor device fabrication, as described above. In particular, ("parallel plate") capacitively coupled plasma (CCP) processing systems or inductively coupled plasma (ICP) processing systems have been used commonly for plasma excitation. Among other or more specific types of plasma sources, there are microwave plasma sources (including those using electron-cyclotron resonance (ECR)), surface wave plasma sources (SWPS), and helicon plasma sources.

It is becoming common wisdom that SWP sources, which include a slot antenna, offer improved plasma processing performance, particularly for etching processes, over CCP systems, ICP systems and resonantly heated systems. SWP sources produce a high degree of ionization at a relatively lower Boltzmann electron temperature ($T_e$) near the processing target (substrate). In addition, SWP sources generally produce plasma richer in electronically excited molecular species with reduced molecular dissociation. However, the practical implementation of SWP sources still suffers from several deficiencies including, for example, plasma stability and uniformity.

For a number of reasons, including charged ions and electrons recombining on chamber walls as they propagate from the source to the substrate, plasma density is often substantially non-uniform near the substrate. For ICP or CCP systems, such plasma density irregularity may be reduced by injecting a fraction of the process gasses into a region near the top of the chamber, and the balance of the gas through a ring near the substrate. This technique is somewhat effective when the electron temperature is sufficiently high to yield effective ionization and plasma-chemical reactions near the gas ring. However, since the average electron temperature in a SWP source that uses a slot antenna is relatively low, only molecules with weak chemical bonds can be cracked effectively near the gas ring. This limits spatial control of the plasma chemistry near the wafer and, therefore impacts the system application range. Therefore, an effective means to control the process plasma density in a surface wave plasma etch system with a slot antenna is needed.

SUMMARY OF THE INVENTION

The present invention provides a surface wave plasma source (SWPS), including an electromagnetic (EM) wave launcher configured to couple EM energy in a desired EM wave mode to a plasma by generating a surface wave on a plasma surface located adjacent the plasma. The EM wave launcher includes a slot antenna having a plurality of antenna slots formed therethrough configured to couple the EM energy from a first region above the slot antenna to a second region below the slot antenna. A dielectric window is positioned in the second region and has a lower surface of the dielectric window including the plasma surface. A slotted gate plate is arranged parallel with the slot antenna and is configured to be movable relative to the slot antenna between variable opacity positions. The positions include a first opaque position in which at least one first gate slot is misaligned with a first arrangement of antenna slots in the plurality of antenna slots to prevent the EM energy from passing through the first arrangements of antenna slots. The positions further include a first transparent position in which the at least one first gate slot is aligned with the first arrangement of antenna slots to allow a full intensity of the EM energy to pass through the first arrangement of antenna slots. A power coupling system is coupled to the EM wave launcher and is configured to provide the EM energy to the EM wave launcher for forming the plasma.

A method for controlling plasma properties in a surface wave plasma source (SWPS) is provided. The method is performed with a surface wave plasma source (SWPS) having an electromagnetic (EM) wave launcher configured to couple EM energy in a desired EM wave mode to a plasma by generating a surface wave on a plasma surface located adjacent the plasma. The EM wave launcher includes a slot antenna having a plurality of antenna slots formed therethrough configured to couple the EM energy from a first region above the slot antenna to a second region below the slot antenna. A dielectric window is positioned in the second region having a lower surface, which includes the plasma surface. A power coupling system is coupled to the EM wave launcher configured to provide the EM energy to the EM wave launcher for forming the plasma.

The method includes controlling a plasma property by changing an orientation of a slotted gate plate with respect to the slot antenna. The slotted gate plate is parallel with the slot antenna and is configured to be movable relative to the slot antenna between variable opacity positions. The variable opacity positions include a first opaque position in which at least one first gate slot is misaligned with a first arrangement of antenna slots in the plurality of antenna slots to prevent the EM energy from passing through the first arrangements of antenna slots. The variable opacity positions also include a first transparent position in which the at least one first gate slot is aligned with the first arrangement of antenna slots to allow a full intensity of the EM energy to pass through the first arrangement of antenna slots.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

For more efficient control over plasma properties in a processing chamber, such as radial distribution of the plasma density, radical density distribution, and the electron energy distribution function, the present invention adjusts the microwave power emission from at least one arrangement of antenna slots in a slot antenna assembly of a Surface Wave Plasma Source ("SWPS"). This can be achieved by "turning on" and "turning off" selected antenna slots by occluding at least some portion of the antenna slot aperture by means of a metal disk ("gate"). In the description that follows, even though references may be made to microwaves or other enumerated bands of electromagnetic emissions, it should be understood that the system and method apply to a wide variety of desired electromagnetic wave modes (waves of a chosen frequency, amplitude, and phase).

Figure 1:
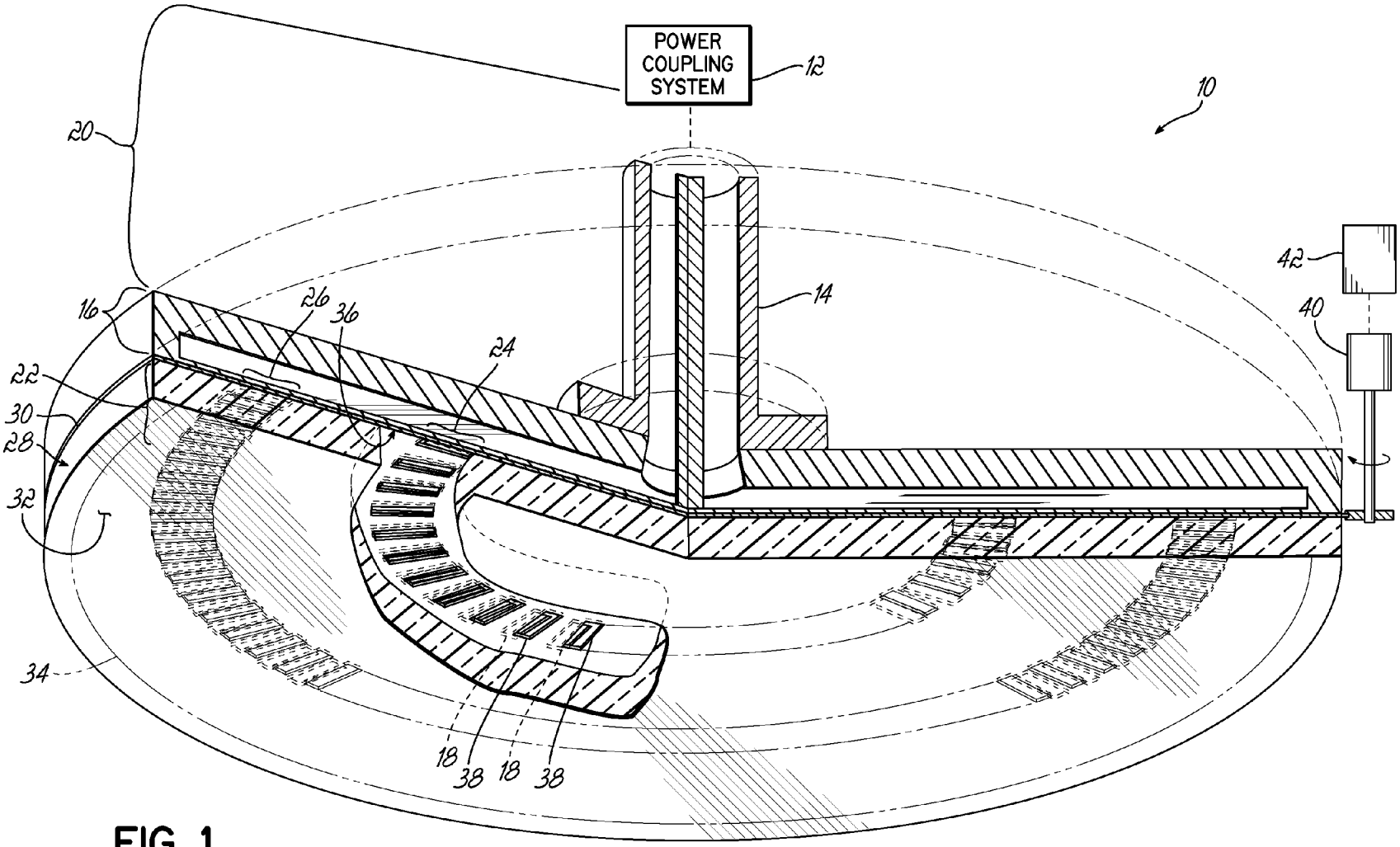
FIG. 1 is a cross-sectional perspective view of an embodiment of the invention.

FIG. 1 depicts a cross-sectional view of a SWPS 10. A power coupling system 12 provides input EM energy into a wave guide 14, which is depicted as a coaxial wave guide 14. Below the coaxial wave guide 14 is a slot antenna 16 including a plurality of antenna slots 18 formed therethrough, where the slot antenna 16 is depicted as a radial line slot antenna. In the description that follows, the slot antenna 16 and antenna slots 18 may be collectively referred to as an EM wave launcher. When energized, the power coupling system 12 generates EM energy in a first region 20 above the slot antenna 16, which EM energy passes through the antenna slots 18 into a second region 22 below the slot antenna 16. In one embodiment, a first arrangement 24 of antenna slots 18 and second arrangement 26 of antenna slots 18 are defined in generally concentric rings. However, first arrangement 24 of antenna slots 18 and a second arrangement 26 of antenna slots 18 may be defined in different geometric configurations to produce desired plasma properties. As indicated above, the slot antenna 16 and the wave guide 14 are depicted and described herein as a radial line slot antenna and coaxial wave guide, respectively. However, it may be appreciated that other types of slot antennas and wave guides may be used in a SWPS 10 of this invention, for example, depending on the geometry of other components in the system, such as the substrate to be processed.

A dielectric window 28 is situated in the second region 22 below the antenna slots 18 of the slot antenna 16. The dielectric window 28 may be fabricated from quartz, or other suitable material that is sufficiently transparent to EM waves and sufficiently ruggedized to withstand adverse operating environments. The dielectric window 28 has an upper surface 30 oriented toward the slot antenna 16, a lower surface 32 defining the entire planar area of the bottom face of the dielectric window 28, and a plasma surface 34 defining at least a portion of the area of the lower surface 32. The plasma surface 34 is the area subjected to contact with generated plasma when in use. The dielectric window 28 may be mated with a wall of a semiconductor processing chamber, to provide a hermetic seal for the chamber, and a portal for transmission of EM waves into the chamber.

To enable adjustment of a property of plasma produced by the transmission of EM waves by the slot antenna 16, a slotted gate plate 36 may be employed. In one embodiment, the slotted gate plate 36 is disposed between the slot antenna 16 and the upper surface 30 of the dielectric window 28. The slotted gate plate 36 includes a plurality of gate slots 38, that penetrate through the full thickness of the slotted gate plate 36. The pattern of gate slots 38 generally duplicates the same configuration as the antenna slots 18 in the first arrangement 24 and/or second arrangement 26 of the slot antenna 16. In the discussion that follows, attention will be focused on adjustment of the first arrangement 24, but one of ordinary skill in the art will appreciate that additional arrangements may be utilized to provide additional degrees of adjustment and variability of the SWPS 10.

The slotted gate plate 36 is fabricated from a material that is substantially opaque to the EM waves used in a semiconductor processing application. In other words, the selected material allows a very small EM penetration depth, and is therefore effective at blocking the transmission of EM waves. In the discussion that follows, references will be made to certain mechanical or electrical theoretical limits (e.g., fully occluded, completely aligned, energy blocked, transparent, opaque, etc.). Due to fabricating tolerances and other variables, those terms shall be deemed to be prefaced with "substantially" whenever practical limitations prevent the aspirational limits from being achieved. The gate slots 38 allow the first arrangement 24 of the slot antenna 16 to be enabled, or turned on, by fully aligning the antenna slots 18 of the slot antenna 16 with the gate slots 38 of the slotted gate plate 36. This allows the full intensity of EM energy to pass through the first arrangement 24 of the slot antenna 16 (i.e., maximum transparency). Alternatively, the gate slots 38 allow the first arrangement 24 of the slot antenna 16 to be disabled, or turned off, by fully misaligning the antenna slots 18 of the slot antenna 16 with the gate slots 38 of the slotted gate plate 36, thereby completely occluding the antenna slot 18. This prevents all EM energy from passing through the first arrangement 24 of the slot antenna 16 (i.e., maximum opacity). In another configuration, the slotted gate plate 36 may be positioned such that the antenna slots 18 of the first arrangement 24 are partially aligned with the gate slots 38 and thus partially occluded by the orientation of the slotted gate plate 36. This allows for a variable degree of transparency or opacity to the passage of EM waves. For example the slotted gate plate 36 could be positioned so that the gate slots 38 overlap a portion of the antenna slots 18 in the first arrangement 24, and thereby allow only one quarter of the EM energy to pass through the first arrangement 24 (i.e., 25% transparency or 75% opacity). This partial overlap alters the area of the antenna slot 18 available for EM transmission, and may be referred to as altering the effective antenna slot area.

The relationship between the antenna slots 18 of the slot antenna 16 and gate slots 38 of the slotted gate plate 36 may be adjusted in several ways. In one embodiment, the slotted gate plate 36 may be linearly translated with respect to the slot antenna 16 along the x-axis, the y-axis, or a combination thereof. In another embodiment, the slotted gate plate 36 may be rotatably adjusted with respect to the slot antenna 16. In yet another embodiment, the slotted gate plate 36 may be both linearly and rotatably adjusted with respect to the slot antenna 16. While the following discussion will focus on various movements of the slotted gate plate 36, it should be appreciated that the relative orientation between the slotted gate plate 36 and slot antenna 16 may be adjusted by movement of the slot antenna 16.

A plurality of regions, such as the first arrangement 24 and the second arrangement 26, may be selectably occluded by using appropriately configured gate slots 38 (as will be explained in detail below). By way of example, rotating the slotted gate plate 36 five degrees could result in complete occlusion of the first arrangement 24, yet complete transparency of the second arrangement 26. By way of further example, rotating the slotted gate plate 36 ten degrees could result in complete alignment with both the first arrangement 24 and second arrangement 26. Alternatively, the first arrangement 24 and the second arrangement 26 may be selectably occluded by using a plurality of slotted gate plates 36. Detailed analysis of illustrative configurations will be provided below.

Figure 2A:
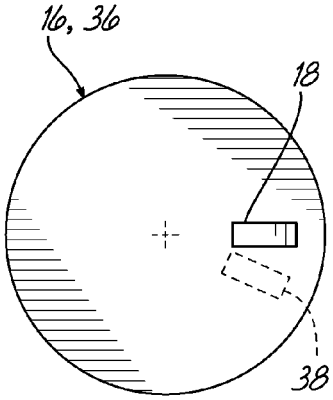
FIGS. 2A-2C are top views of various antenna slot and gate slot configurations according to embodiments of the invention.
Figure 2B:
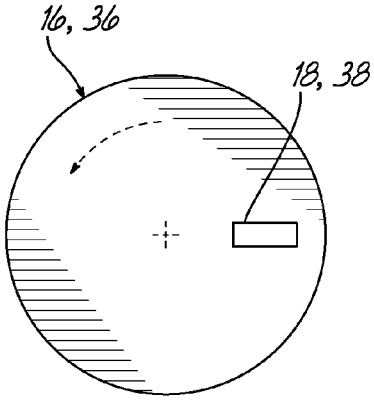
Figure 2C:
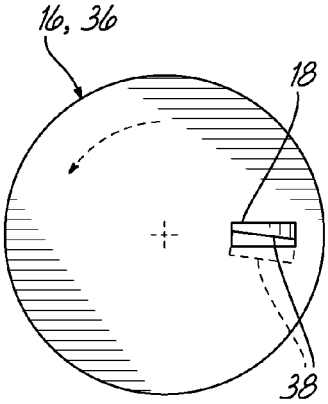

Referring now to FIGS. 2A-2C, these drawings illustrate three rotatable configurations of an antenna slot 18 of the slot antenna 16 in relation to a gate slot 38 of the slotted gate plate 36. While only one antenna slot 18 and one gate slot 38 have been shown for the sake of clarity, the interaction between the antenna slot 18 and gate slot 38 apply equally to the plurality of each in the first arrangement 24 and/or second arrangement 26. In each of FIGS. 2A-4E, a top-down view is depicted, wherein the slot antenna 16 is situated on top (i.e., closest to the reader), and the slotted gate plate 36 is situated beneath or behind the slot antenna 16. In FIG. 2A, the misaligned relationship between gate slot 38 (shown with hidden lines) and antenna slot 18 results in a fully occluded, or off, configuration. This may be referred to as a first opaque position, and in this configuration all EM energy is precluded from passing through the antenna slot 18. FIG. 2B shows the opposite functional configuration, wherein the gate slot 38 and the antenna slot 18 are in complete alignment. This configuration may be referred to as a first transparent position, and all EM energy is permitted to pass through the antenna slot 18 of the slot antenna 16. In FIG. 2C, an intermediate relationship is achieved, wherein the antenna slot 18 is only partially aligned with and thus partially occluded by a portion of the gate slot 38 and slotted gate plate 36. This configuration may be referred to as a first intermediate opacity position, where only a portion of the EM energy is permitted to pass through. The varying percentages of occlusion, and corresponding percentages of EM energy transmission, may be achieved by rotating the slotted gate plate 36 to one or more intermediate opacity positions between the opaque position and the transparent position. This adjustable percentage of occlusion may be referred to as variable opacity to EM energy.

Figure 3A:
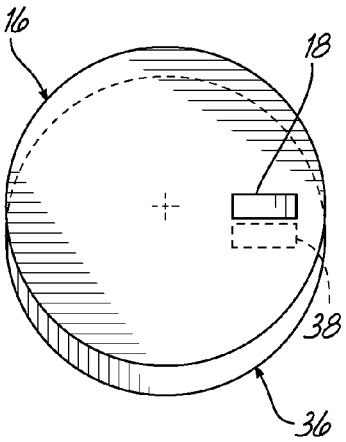
FIGS. 3A-3C are top views of various antenna slot and gate slot configurations according to embodiments of the invention.
Figure 3B:
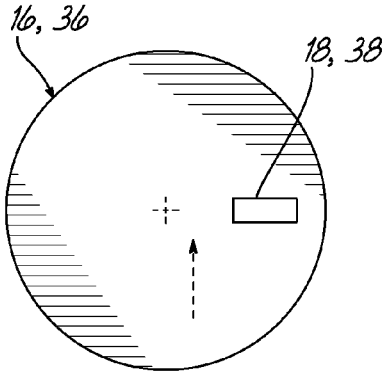
Figure 3C:
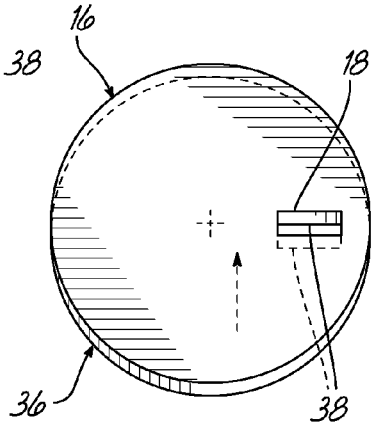

FIGS. 3A-3C depict several configurations of an antenna slot 18 of the slot antenna 16 in relation to a gate slot 38 of the slotted gate plate 36, wherein the slotted gate plate 36 has been linearly translated. While this example shows linear translation along the y-axis, the translation description is equally applicable to a movement in a plurality of axes, either individually or in combination. In FIG. 3A, the misaligned relationship between the gate slot 38 (shown with hidden lines) and the antenna slot 18 results in a fully occluded, or off, configuration, referred to as the opaque position, in which all EM energy is precluded from passing through the antenna slot 18. FIG. 3B shows the opposite functional configuration, wherein the gate slot 38 and the antenna slot 18 are in complete alignment, referred to as the transparent position, in which all EM energy is permitted to pass through the antenna slot 18 of the slot antenna 16. In FIG. 3C, the intermediate relationship is achieved, wherein the antenna slot 18 is only partially occluded by a portion of the gate slot 38 and slotted gate plate 36. Varying percentages of occlusion, and corresponding percentages of EM energy transmission, may be achieved by linearly translating the slotted gate plate 36 among intermediate opacity positions between the opaque position and the transparent position.

Figure 4A:
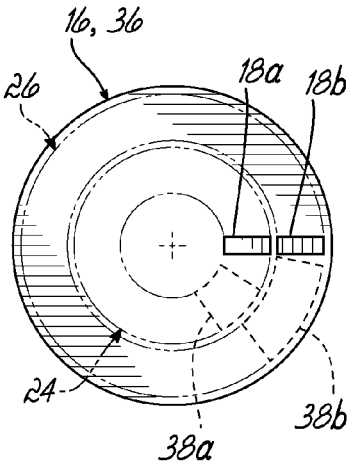
FIGS. 4A-4E are top views of various antenna slot and gate slot configurations according to embodiments of the invention.
Figure 4B:
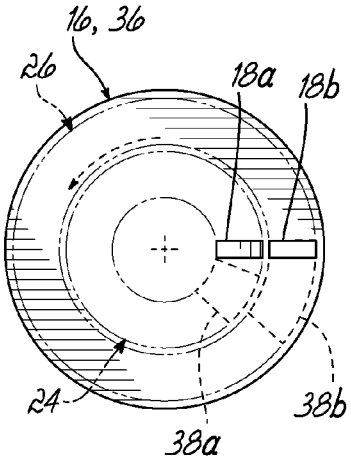
Figure 4C:
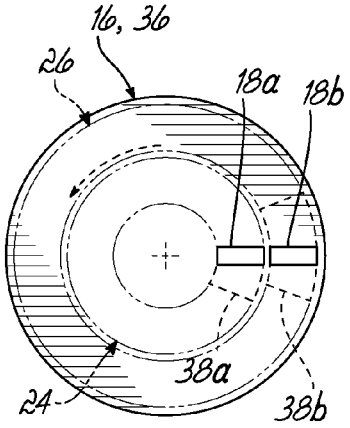
Figure 4D:
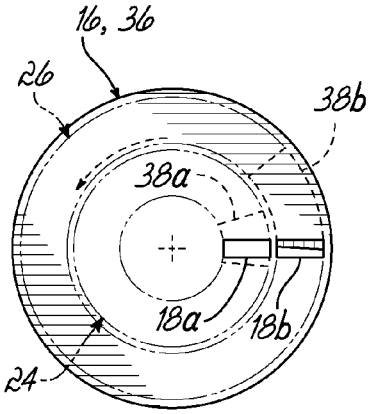
Figure 4E:
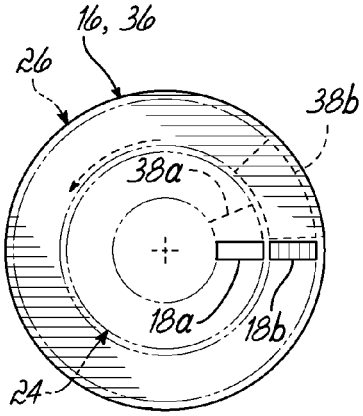

While FIGS. 2A-3C were directed at apparatus for adjusting the opacity of an antenna slot 18 in a first arrangement 24, it is possible to simultaneously and independently control opacity in a second arrangement 26. FIGS. 4A-4E show various configurations of an embodiment wherein a slot antenna 16 has an antenna slot 18*a* in a first arrangement 24 and an antenna slot 18*b* in a second arrangement 26. A plurality of enlarged gate slots 38*a*-38*b* are shown with hidden lines. In this configuration, gate slots 38*a* and 38*b* each has a surface area larger than the surface area of corresponding antenna slots 18*a* and 18*b*. As a result, the slotted gate plate 36 may be rotated through several different angular positions, while still allowing the gate slots 38*a* and 38*b* to permit full transmission of EM energy through the corresponding antenna slots 18*a* and 18*b*. These several different angular positions thus collectively define a variably transparent or opaque position by altering the area of the gate slots 38*a* and 38*b* relative to the area of the antenna slots 18*a* and 18*b*. FIG. 4A shows the antenna slots 18*a* and 18*b* as being completely occluded by the slotted gate plate 36, i.e., the relationships between the gate slots 38*a* and 38*b* and the antenna slots 18*a* and 18*b* are the first and second opaque positions, respectively. As the slotted gate plate 36 is rotated counterclockwise, FIG. 4B shows that gate slot 38*b* is oriented to allow complete propagation of EM waves through antenna slot 18*b*, i.e., a second transparent position, while the slotted gate plate 36 completely obscures antenna slot 18*a* and prevents EM waves from passing, i.e. a first opaque position. As the slotted gate plate 36 is rotated further counterclockwise, FIG. 4C shows that gate slot 38*a* is positioned to allow full propagation of EM waves through antenna slot 18*a*, and likewise, gate slot 38*b* is positioned to allow full propagation of EM wave through antenna slot 18*b*, i.e. first and second transparent positions. FIG. 4D illustrates one of a plurality of configurations wherein one antenna slot 18 is either completely open (and thus in the first transparent position) or completely closed (and thus in the first opaque position). In this illustration, antenna slot 18*a* is completely open (and thus in the first transparent position), while the second antenna slot 18 has a variable intermediate opacity (here, antenna slot 18*b* is approximately 50% occluded and thus in a second intermediate opacity position). Lastly, as the slotted gate plate 36 is rotated further counterclockwise, FIG. 4E shows that the slotted gate plate 36 completely obscures antenna slot 18*b* and prevents EM waves from passing, while gate slot 38*a* is oriented to allow full propagation of EM waves through antenna slot 18*a*, i.e., the second opaque position and first transparent position, respectively.

Figure 5:
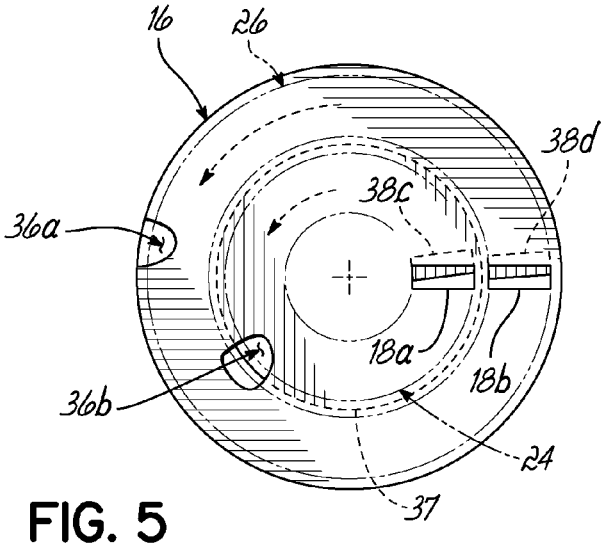
FIG. 5 is a top view of a two plate embodiment of the invention.

In another embodiment, FIG. 5 shows a plurality of slotted gate plates 36*a* and 36*b* nested in a generally coplanar and coaxial configuration that are used to control the opacity of the first arrangement 24 and second arrangement 26. For example, an outer slotted gate plate 36*a* (having a single gate slot 38*c*, for the sake of clarity) and inner slotted gate plate 36*b* (having a single gate slot 38*d*, for the sake of clarity) are shown FIG. 5. The outer slotted gate plate 36*a* and inner slotted gate plate 36*b* may be rotatably positioned with respect to each other and with respect to the slot antenna 16. To maintain the highest degree of coplanar orientation, the outer slotted gate plate 36*a* and inner slotted gate plate 36*b* may be nested with a clearance fit at a parting region 37 that is dimensioned to mitigate passage of EM energy to an acceptable level. Alternatively, if slight deviation from the coplanar orientation is acceptable, the parting region 37 may include overlapping of the outer slotted gate plate 36*a* and inner slotted gate plate 36*b*. In yet another embodiment, the parting region 37 may include an interlocking flange between the mating perimeters of the outer slotted gate plate 36*a* and the inner slotted gate plate 36*b*. In this orientation, the major area of the outer slotted gate plate 36*a* and inner slotted gate plate 36*b* is on the same plane, but the flanged parting line 37 portion will be raised.

By using two slotted gate plates 36*a* and 36*b*, the opacity of the first arrangement 24 and second arrangement 26 may be adjusted completely independently of each other. For example, the opacity of the first arrangement 24 may be set to 50%, i.e. a first intermediate opacity position of 50%, and the second arrangement 26 may be set to 50%, i.e. a second intermediate opacity position of 50%. In another example, the opacity of the first arrangement 24 may be set to 20% and the second arrangement 26 may be set to 40%. In another embodiment, the outer slotted gate plate 36*a* and inner slotted gate plate 36*b* may be semi-permanently joined together to produce a fixed offset between the opacity of the first arrangement 24 and the second arrangement 26. For example, if the outer slotted gate plate 36*a* and the inner slotted gate plate 36*b* are joined to produce opacity in the second arrangement 26 of 20% and first arrangement 24 of 30%, respectively, rotating the joined outer slotted gate plate 36*a* and the inner slotted gate plate 36*b* will produce opacities of 40% and 50%, respectively, 45% and 55%, respectively, etc.

The slotted gate plate 36 in FIG. 1 may include a drive system 40 to manipulate the orientation of the slotted gate plate 36 with respect to the slot antenna 16. The drive system 40 may include bearings or suspension mechanisms to support the slotted gate plate 36 and to enable it to be moveably positioned with respect to the slot antenna 16. The drive system 40 may also include linear actuators, stepper motors, solenoids, electromagnets or the like. As one of ordinary skill in the art will appreciate, certain actuators are well suited to fine degrees of adjustment, while others are more useful for binary operation. For example, a solenoid may be acceptable to drive the slotted gate plate 36 from the first occluded position to the first transparent position, but may be ill suited to orient the slotted gate plate 36 to one of a plurality of positions in-between the first occluded position and the first transparent position. For such an application, a stepper motor is well suited. For both rotation and linear translation of the slotted gate plate 36, a stepper motor having sufficient resolution, or a geared assembly to improve the perceived resolution of the stepper motor, may be employed. For embodiments including the outer slotted gate plate 36*a* and inner slotted gate plate 36*b*, a separate drive system (not shown) may be used to support and control the outer slotted gate plate 36*a* and inner slotted gate plate 36*b* independently of each other. Alternatively, if the outer slotted gate plate 36*a* and inner slotted gate plate 36*b* are semi-permanently joined together, the drive system will act on the two slotted gate plates 36*a* and 36*b* as a collective unit.

A controller 42 may also be employed to direct the drive mechanism 40 to automatically adjust the slotted gate plate 36 to desired locations by rotating or translating the slotted gate plate 36. In one embodiment, the controller 42 is configured with a plurality of opacity percentages and corresponding locations of the slotted gate plate 36. A user, by using the controller 42 in conjunction with the drive mechanism 40, may enter a desired opacity value (processing opacity) and the system 10 will automatically move the slotted gate plate 36 to the appropriate corresponding position. In another embodiment, a desired opacity may be supplied by automated systems that are in communication with the SWPS 10. In yet another embodiment, a desired opacity may be either a factory configured parameter or specified by a processing recipe.

The SWPS 10 described above may be used to perform a method of controlling a property of plasma. The method may be performed with a surface wave plasma source (SWPS) 10 having an electromagnetic (EM) wave launcher configured to couple EM energy in a desired EM wave mode to a plasma. This may be accomplished by generating a surface wave on a plasma surface 34 located adjacent the plasma. The EM wave launcher includes a slot antenna 16 having a plurality of antenna slots 18 formed therethrough configured to couple the EM energy from a first region 20 above the slot antenna to a second region 22 below the slot antenna 16. In certain embodiments, a Radial Line Slot Antenna may be used, but other applications may benefit from slot antennas 16 having different geometries. A dielectric window 28 is positioned in the second region 22. The dielectric window 28 may have a lower surface 32, which includes the plasma surface 34. A certain portion of the area of the lower surface 32 is often obscured when mounting the dielectric window 28 to a processing chamber. Therefore, the area of the plasma surface 34 is less than or equal to the area of the lower surface 32. A power coupling system 12 is coupled to the EM wave launcher configured to provide the EM energy to the EM wave launcher for forming the plasma.

The method includes controlling a plasma property by changing an orientation of a slotted gate plate with respect to the slot antenna. The slotted gate plate is parallel with the slot antenna and is configured to be movable relative to the slot antenna between variable opacity positions. The variable opacity positions include a first opaque position in which at least one first gate slot is misaligned with a first arrangement of antenna slots in the plurality of antenna slots to prevent the EM energy from passing through the first arrangements of antenna slots. The variable opacity positions also include a first transparent position in which the at least one first gate slot is aligned with the first arrangement of antenna slots to allow a full intensity of the EM energy to pass through the first arrangement of antenna slots.

In one embodiment, controlling a plasma property includes controlling a radial plasma density (i.e., a plasma density at a given radius from the center of the processing chamber or substrate). In another embodiment, controlling a plasma property includes controlling a radical density distribution (i.e., a distribution of radicals throughout the volume of a plasma). In yet another embodiment, controlling a plasma property includes controlling an electron energy distribution function (i.e., a distribution of electron energies, or speeds, in a plasma). Other plasma properties may be controlled as recognized by one of ordinary skill in the art.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A surface wave plasma source (SWPS), comprising:

an electromagnetic (EM) wave launcher configured to couple EM energy in a desired EM wave mode to a plasma by generating a surface wave on a plasma surface located adjacent said plasma, said EM wave launcher comprising a slot antenna having a plurality of antenna slots formed therethrough configured to couple said EM energy from a first region above said slot antenna to a second region below said slot antenna;

a dielectric window positioned in said second region and having a lower surface of said dielectric window including said plasma surface;

a slotted gate plate arranged parallel with said slot antenna and configured to be movable relative to said slot antenna between variable opacity positions including a first opaque position in which at least one first gate slot is misaligned with a first arrangement of antenna slots in said plurality of antenna slots to prevent said EM energy from passing through said first arrangements of antenna slots, and a first transparent position in which said at least one first gate slot is aligned with said first arrangement of antenna slots to allow a full intensity of said EM energy to pass through said first arrangement of antenna slots; and a power coupling system coupled to said EM wave launcher and configured to provide said EM energy to said EM wave launcher for forming said plasma.

2. The surface wave plasma source of claim 1, wherein said slotted gate plate is linearly translatable relative to said slot antenna.

3. The surface wave plasma source of claim 1, wherein said slotted gate plate is rotatable relative to said slot antenna.

4. The surface wave plasma source of claim 1, wherein said variable opacity positions include one or more first intermediate opacity positions between said first opaque position and said first transparent position in which said at least one first gate slot is partially aligned with said first arrangement of antenna slots to allow a fraction of said EM energy to pass through said first arrangement of antenna slots.

5. The surface wave plasma source of claim 4, further comprising a drive mechanism operably coupled to said slotted gate plate and configured to support and adjustably move said slotted gate plate with respect to said slot antenna.

6. The surface wave plasma source of claim 5, further comprising a controller coupled to said drive mechanism and configured to direct said drive mechanism to move said slotted gate plate to a selected variable opacity position.

7. The surface wave plasma source of claim 6, wherein said controller is configured to determine said selected variable opacity position from a supplied opacity value.

8. The surface wave plasma source of claim 1, wherein said slotted gate plate is located between said dielectric window and said slot antenna.

9. The surface wave plasma source of claim 1 including at least a second gate slot in said slotted gate plate and further including a second arrangement of antenna slots in said plurality of antenna slots, wherein said variable opacity positions include a second opaque position in which said at least one second gate slot is misaligned with said second arrangement of antenna slots to prevent said EM energy from passing through said second arrangement of antenna slots, and a second transparent position in which said at least one second gate slot is aligned with said second arrangement of antenna slots to allow said full intensity of said EM energy to pass through said second arrangement of antenna slots.

10. The surface wave plasma source of claim 9, wherein said variable opacity positions include one or more second intermediate opacity positions between said second opaque position and said second transparent position in which said at least one second gate slot is partially aligned with said second arrangement of antenna slots to allow a fraction of said EM energy to pass through said second arrangement of antenna slots.

11. The surface wave plasma source of claim 1 further comprising a second slotted gate plate disposed coaxial and coplanar to said slotted gate plate that includes at least one second gate slot arranged parallel to a second arrangement of antenna slots in said plurality of antenna slots, wherein said variable opacity positions include a second opaque position in which said at least one second gate slot is misaligned with said second arrangement of antenna slots to prevent said EM energy from passing through said second arrangement of antenna slots, and a second transparent position in which said at least one second gate slot is aligned with said second arrangement of antenna slots to allow said full intensity of said EM energy to pass through said second arrangement of antenna slots.

12. The surface wave plasma source of claim 11, wherein said second slotted gate plate is moveable independently of said slotted gate plate.

13. A method for controlling plasma properties in a surface wave plasma source (SWPS) having an electromagnetic (EM) wave launcher configured to couple EM energy in a desired EM wave mode to a plasma by generating a surface wave on a plasma surface located adjacent said plasma, said EM wave launcher comprising a slot antenna having a plurality of antenna slots formed therethrough configured to couple said EM energy from a first region above said slot antenna to a second region below said slot antenna; a dielectric window positioned in said second region having a lower surface including said plasma surface; and a power coupling system coupled to said EM wave launcher and configured to provide said EM energy to said EM wave launcher for forming said plasma, the method comprising:

controlling a plasma property by changing an orientation of a slotted gate plate with respect to said slot antenna, wherein said slotted gate plate is parallel with said slot antenna and configured to be movable relative to said slot antenna between variable opacity positions including a first opaque position in which at least one first gate slot is misaligned with a first arrangement of antenna slots in said plurality of antenna slots to prevent said EM energy from passing through said first arrangements of antenna slots, and a first transparent position in which said at least one first gate slot is aligned with said first arrangement of antenna slots to allow a full intensity of said EM energy to pass through said first arrangement of antenna slots.

14. The method of claim 13, wherein changing said orientation of said slotted gate plate with respect to said slot antenna includes moving said slotted gate plate to said first opaque position.

15. The method of claim 13, wherein changing said orientation of said slotted gate plate with respect to said slot antenna includes moving said slotted gate plate to said first transparent position.

16. The method of claim 13, wherein changing said orientation of said slotted gate plate with respect to said slot antenna includes moving said slotted gate plate to an intermediate opacity position between said first opaque position and said first transparent position.

17. The method of claim 16, wherein said position between said first opaque position and said first transparent position is varied as a function of time during operation of said SWPS.

18. The method of claim 13, further comprising:

using a drive mechanism operably connected to said slotted gate plate, to move said slotted gate plate with respect to said slot antenna.

19. The method of claim 13, in an SWPS further including a second gate slot in said slotted gate plate corresponding to a second arrangement of antenna slots in said plurality of antenna slots, the method further comprising:

adjusting an opacity of said second arrangement of antenna slots in said plurality of antenna slots by moving said slotted gate plate with respect to said slot antenna.

20. The method of claim 13, in an SWPS further including a second gate slot in a second slotted gate plate corresponding to a second arrangement of antenna slots in said plurality of antenna slots, the method further comprising:

adjusting an opacity of said second arrangement of antenna slots in said plurality of antenna slots by moving said second slotted gate plate with respect to said slot antenna.

* * * * *

UNITED STATES PATENT AND TRADEMARK OFFICE

CERTIFICATE OF CORRECTION

PATENT NO. : 9,155,183 B2
APPLICATION NO. : 13/750392
DATED : October 6, 2015
INVENTOR(S) : Sergey A. Voronin et al.

It is certified that error appears in the above-identified patent and that said Letters Patent is hereby corrected as shown below:

In the Specification:

In Col. 1, lines 62-63, "plasma stability and uniformity." should read --plasma instability and nonuniformity.--.

In Col. 6, line 28, "each has a surface" should read --each have a surface--.

In Col. 7, line 8, "shown FIG. 5." should read --shown in FIG. 5.--.

In the Claims:

In Col. 9, line 31, Claim 1, "said first arrangements" should read --said first arrangement--.

In Col. 10, line 58, Claim 13, "said first arrangements" should read --said first arrangement--.

Signed and Sealed this
Twenty-second Day of March, 2016

Michelle K. Lee

Michelle K. Lee
*Director of the United States Patent and Trademark Office*